US012490785B2

(12) United States Patent
Cavell

(10) Patent No.: US 12,490,785 B2
(45) Date of Patent: Dec. 9, 2025

(54) PERSONAL IMPACT PROTECTION SYSTEM

(71) Applicant: AUTOLIV DEVELOPMENT AB, Vargarda (SE)

(72) Inventor: Christian Cavell, Starnberg (DE)

(73) Assignee: AUTOLIV DEVELOPMENT AB, Vargarda (SE)

( * ) Notice: Subject to any disclaimer, the term of this patent is extended or adjusted under 35 U.S.C. 154(b) by 0 days.

(21) Appl. No.: 18/256,323

(22) PCT Filed: Dec. 6, 2021

(86) PCT No.: PCT/EP2021/084364
§ 371 (c)(1),
(2) Date: Jun. 7, 2023

(87) PCT Pub. No.: WO2022/122641
PCT Pub. Date: Jun. 16, 2022

(65) Prior Publication Data

US 2024/0032624 A1 Feb. 1, 2024

(30) Foreign Application Priority Data

Dec. 11, 2020 (DE) ..... 10 2020 133 158.4

(51) Int. Cl.
*A41D 13/018* (2006.01)

(52) U.S. Cl.
CPC ..... *A41D 13/018* (2013.01)

(58) Field of Classification Search
CPC .... A41D 13/018; A41D 13/05; A41D 13/015; A41D 1/002
See application file for complete search history.

(56) References Cited

U.S. PATENT DOCUMENTS

| | | | | |
|---|---|---|---|---|
| 2005/0067816 | A1* | 3/2005 | Buckman | A41D 13/018 280/730.1 |
| 2015/0101112 | A1* | 4/2015 | Balbien | A41D 13/018 2/455 |
| 2016/0207486 | A1* | 7/2016 | Wahl | B60R 22/00 |
| 2017/0057453 | A1* | 3/2017 | Morris | B60R 21/239 |
| 2017/0325521 | A1* | 11/2017 | Li | A41D 13/018 |
| 2020/0021124 | A1* | 1/2020 | Howe | H02J 3/00 |
| 2020/0205488 | A1 | 7/2020 | Bouquillard De Milleret | |
| 2020/0329789 | A1* | 10/2020 | Cholhan | A41D 13/018 |

* cited by examiner

*Primary Examiner* — Uyen T Nguyen
(74) *Attorney, Agent, or Firm* — DICKINSON WRIGHT PLLC

(57) ABSTRACT

A personal impact protection system including a plurality of discrete wearable inflatable items configured to be worn on or around respective parts of a user's body. At least one inflator is configured to produce inflating gas to inflate the inflatable items when worn by the user, and a control system is provided to actuate the inflator in response to an actuation signal to: i) inflation of all of the inflatable items; ii) inflation of some but not all of the inflatable items; and iii) inflation of a single one of the inflatable items.

7 Claims, 9 Drawing Sheets

PERSONAL IMPACT PROTECTION SYSTEM

FIELD OF THE INVENTION

The present invention relates to a personal impact protection system. More particularly, the invention relates to a personal impact protection system comprising a plurality of discrete wearable inflatable items.

BACKGROUND

It has been proposed previously to provide personal impact protection systems which are configured to be worn by a user and which comprise an airbag or other inflatable item. The premise of such systems is that the airbag is intended to be inflated in the event that the system detects the user falling or being about to fall, experiencing a collision with a motor vehicle, motorcycle, bicycle or the like, or otherwise being at risk of potentially injurious impact with an object or obstacle. As will be appreciated by those of skill in the art, inflation of the airbag is intended to provide a cushioning effect to absorb impact energy, and thereby reduce the likelihood of the user being injured in the event of a fall or impact with an obstacle or object. Personal impact protection systems of this general type are therefore considered useful in providing protection to vulnerable road users (VRUs), for example: pedestrians; cyclists; motorcyclists; scooter riders and the like.

Previously proposed personal impact protection systems of the general type noted above, have been found to be somewhat cumbersome and restrictive to wear, whilst offering little flexibility in terms of their inflation characteristics. For example, such systems typically comprise a single airbag which is often very large and voluminous, and which is often designed to offer effective impact protection only for a very specific type of fall or impact situation. In other previously proposed systems, a large inflatable airbag may be provided as part of an inflatable suit, and is configured to provide effective impact protection for a very wide range of potential impacts. In such arrangements, the airbag is often very large indeed, to ensure effective protection over a large proportion of the user's body, which results in the need for a very large volume of inflating gas, and thus a very large inflator which can be cumbersome, particularly given that the inflator must generally be provided in combination with an electronic control unit and a battery. Also, such proposals often suffer from slow inflation times, due to the large volume of their airbags.

The present invention has been devised in light of the above considerations.

SUMMARY OF THE INVENTION

According to the present invention, there is provided a personal impact protection system comprising: a plurality of discrete wearable inflatable items configured to be worn on or around respective parts of a user's body; at least one inflator configured to produce a flow of inflating gas to inflate said inflatable items when worn by the user; and a control system operably connected to the or each said inflator and configured to actuate the or each said inflator in response to an actuation signal and in accordance with an inflation characteristic selected from a group of possible inflation characteristics comprising: i) inflation of all of said inflatable items; ii) inflation of some but not all of said inflatable items; and iii) inflation of a single one of said inflatable items; wherein said control system is configured to select said inflation characteristic in dependence on at least one of: said actuation signal; and a determination of which of said inflatable items are worn by the user.

In some embodiments, it is proposed that the or at least one said inflator may be provided in the form of a dual-stage inflator of a type configured to provide two discrete stages of inflation.

Conveniently, the system is modular and comprises a number of said wearable inflatable items from which a user may select one or more items to be worn, wherein at least one of said control system and said algorithm is configured to determine which of said inflatable items are worn and to select said inflation characteristic in dependence thereon.

In some embodiments, said control system comprises at least one controller operably connected to the or each said inflator and configured to implement an actuation algorithm.

Optionally, said control system comprises at least one gyro sensor configured to produce a said actuation signal in response to detection of angular velocity exceeding a predetermined threshold value.

In some embodiments, the personal impact protection system comprises a single said controller.

Optionally, the personal impact protection system, comprises a single said inflator, and said inflatable items are each fluidly connectable to said single inflator to receive a flow of inflating gas from the inflator according to said actuation algorithm.

In some embodiments, said plurality of inflatable items includes a primary inflatable item which includes said single inflator and which is configured to receive inflating gas directly from said inflator.

The primary inflatable item may be configured to be worn on or around a user's torso.

Conveniently, said plurality of inflatable items includes at least one secondary inflatable item, the or each said secondary inflatable item being releasably fluidly connectable to said primary inflatable item to receive a flow of inflating gas indirectly from said single inflator via said primary inflatable item when connected to the primary inflatable item.

The or each secondary inflatable item may be configured to be worn on or around part of a user's body selected from a group comprising the user's: head, arms, legs, feet, hands, and hips.

In some embodiments, it is proposed that the or each said secondary inflatable item may be releasably fluidly connectable to said primary inflatable item by a respective flow connector forming part of said control system, and the or each flow connector may comprise a respective switchable pressure relief valve and be configured to switch the pressure relief valve between an operable condition and an inoperable condition in dependence on whether or not the respective secondary inflatable item is fluidly connected to said primary inflatable item. The or each pressure release valve may be configured, in its operable condition, to vent said primary inflatable item to atmosphere in response to inflation pressure within the primary inflatable item exceeding a predetermined threshold, and may be configured, in said inoperable condition, not to vent said primary inflatable item.

Optionally, the or each said connector is configured to: i) switch its respective pressure relief valve from said operable condition to said inoperable condition upon connection of a respective said secondary inflatable item to said primary inflatable item; and ii) to switch its respective pressure relief valve from said inoperable condition to said operable condition upon disconnection of said respective secondary inflatable item from said primary inflatable item.

Conveniently, said control system may comprise a single controller configured to implement said actuation algorithm, said controller being configured to: i) actuate said inflator in accordance with said actuation algorithm, and ii) detect connection and disconnection of the or each secondary inflatable item to said primary inflatable item and to control switching of the or each respective pressure relief valve between said operable condition and said inoperable condition in response to said detection.

It is proposed that said primary inflatable item may comprise a primary controller configured to actuate said inflator in accordance with said actuation algorithm, and wherein the or each said secondary inflatable item comprises a respective secondary controller. The or each said secondary controller may be configured to detect connection and disconnection of the respective secondary inflatable item to said primary inflatable item and to control switching of the respective pressure relief valve between said operable condition and said inoperable condition in response to said detection.

In some embodiments of the invention, it is proposed that each inflatable item may comprise a respective said inflator, with each inflatable item being configured to receive inflating gas directly from its respective inflator.

In some embodiments, the system may comprise a single said controller operably connected to each inflator and configured to implement said actuation algorithm. The single controller may be provided as part of one of said inflatable items.

Alternatively, embodiments are envisaged in which each inflatable item comprises a respective said controller, each controller being operably connected to the respective inflator.

It is proposed that each inflatable item may comprise a respective gyro sensor configured to produce a respective actuation signal in response to detection of angular acceleration exceeding a predetermined threshold value.

The wearable inflatable items may take the form of garments.

The wearable inflatable items may comprise, or consist of, an inflatable airbag. The or each airbag may be formed from flexible fabric material or the like, and it is proposed that prior to actuation the airbags will each be tightly rolled and/or folded into a respective airbag package.

The wearable inflatable items can take various different forms. For example, one or more of the wearable inflatable items may comprise or take the form of: a helmet; a hat; a cap; a vest; a jacket; a shirt; an elbow pad; a knee pad; a belt; a harness; a backpack or rucksack; a shoe; a sock; a glove; trousers or pants; leggings; a leg sleeve; an arm sleeve; a collar; a harness; a wristband or the like.

It is proposed that in some embodiments, the personal impact protection system may be configured to be controlled by a computer device such as, for example, a smartphone or tablet device, or a smartwatch. In such a proposal, the computer device may be worn or carried by a user of the personal impact protection system. For example, one or more of the wearable inflatable garments may comprise a pocket or pouch to receive a smartphone or tablet device. The computer device, e.g. smartphone, may form part of the system's control system, and may optionally form the, or a, said controller. In such a proposal, it is envisaged that an accelerometer in the smartphone may represent the, or at least one of the aforementioned gyro sensor(s), and the smartphone may be configured to produce said actuation signal. It is envisaged that the smartphone or other type of computer device may be configured to run a software application configured to control the personal impact protection system, and may, for example, be configured to transmit said actuation signal wirelessly to a receiver forming part of the control system.

SUMMARY OF THE FIGURES

So that the invention may be more readily understood, and so that further features thereof may be appreciated, embodiments of the invention will now be described by way of example with reference to the accompanying drawings in which.

DETAILED DESCRIPTION OF THE INVENTION

Aspects and embodiments of the present invention will now be discussed with reference to the accompanying figures. Further aspects and embodiments will be apparent to those skilled in the art.

Figure 1:
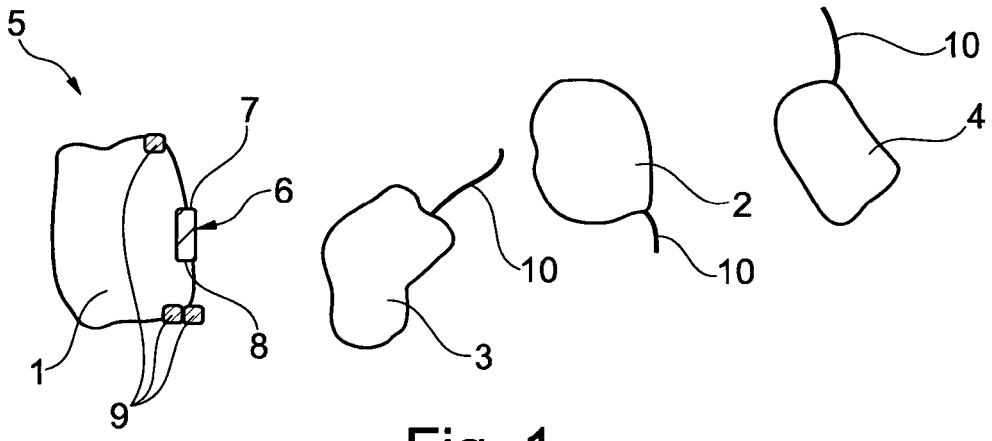
FIG. 1 is a schematic illustration showing a number of wearable inflatable items forming part of a personal impact protection system, from which a user may select items to be worn.

FIG. 1 illustrates a number of discrete wearable inflatable items 1-4, each of which comprises an inflatable airbag of a type known per se, and is configured to form part of a modular personal impact protection system 5 in accordance with the present invention. More particularly, it is to be understood that each of the wearable inflatable items 1-4 is configured to be worn by a user of the system 5 either on, or around, a respective part of the user's body. It is to be understood from the outset that whilst four specific wearable inflatable items 1-4 are illustrated and described herein, it is proposed that the system of the present invention may comprise more or fewer than four wearable inflatable items.

As will be described in more detail hereinafter, the specific collection of wearable inflatable items 1-4 illustrated in FIG. 1 includes a primary inflatable wearable item 1, and a number of secondary inflatable wearable items 2-4. In the illustrated embodiment, the primary inflatable wearable item 1 takes the form of a vest, and the secondary wearable inflatable items include a helmet 2, and a pair of knee pads 3, 4. It is to be appreciated, however, that the individual inflatable wearable items can take various different or alternative forms. For example, it is proposed that the system 5 of the present invention could include individual wearable items taking the form of a helmet; a hat; a cap; a vest; a jacket; a shirt; an elbow pad; a knee pad; a belt; a harness; a backpack or rucksack; a shoe; a sock; a glove; trousers or pants; leggings; a leg sleeve; an arm sleeve; a collar; a harness; a wristband, or indeed any other suitable type of garment or the like. Furthermore, it possible for any of the aforementioned garments or items to take the form of a primary inflatable wearable item. The illustrated embodiment comprising a vest, a helmet, and a pair of knee pads is merely provided as an example.

FIG. 1 illustrates the various wearable inflatable items 1-4 (hereinafter referred to simply as "inflatable items", for convenience) in their normal configuration, prior to inflation, in which they generally resemble otherwise normal garments of their respective type. The inflatable airbag of each inflatable item 1-4 is initially provided in a tightly rolled and/or folded package and is hidden behind a fabric or other covering provided as part of the inflatable item. As will be readily appreciated by those of skill in the art, the airbag of each inflatable item is configured to inflate upon actuation, and to thereby burst through the covering of the item (for example via a tear seam or the like) so to achieve a deployed position substantially outside the covering of the garment, to provide impact protection to the user of the system.

In the embodiment illustrated in FIG. 1, the primary inflatable item 1 includes an actuator unit 6 which comprises an inflator 7 such as a gas generator of a type known per se, and a controller 8 which may be provided in the form of an electronic control unit (ECU). It is proposed that the ECU may include a battery, and preferably a rechargeable battery. Whilst FIG. 1 illustrates the inflator 7 and the controller 8 being combined into a single actuator unit 6, it is to be appreciated that variants are envisaged in which the inflator 7 and the controller 8 may be provided as discrete units, and optionally at different positions on the inflatable item 1. The controller 8 forms part of a control system, is operably connected to the inflator 7, and is configured to actuate the inflator 7 in response to an actuation signal and in accordance with an actuation algorithm. The actuation algorithm may be embodied in software run by the controller 8 or, as will be explained hereinafter, may (at least partially) be embodied in software run on an external device. It will be understood that the inflator 7 is configured to produce a large volume of inflating gas upon actuation, and to direct the inflating gas into the interior volume of the airbag of the primary inflatable item 1, to thereby inflate the primary inflatable item 1. In the embodiment illustrated in FIG. 1, the actuation unit 6 further comprises a gyro sensor configured to produce the aforementioned actuation signal in response to the detection of angular acceleration exceeding a predetermined threshold value indicative of the user being likely to suffer an impact. In other embodiments, it is proposed that the actuation unit 6 may comprise more than one gyro sensor. Additionally, or alternatively, the actuation unit 6 may comprise one or more accelerometers configured to produce an actuation signal in response to the detection of linear acceleration in one or more directions exceeding a predetermined threshold value indicative of the user being likely to suffer an impact. The provision of one or more gyro sensors and/or accelerometers can provide a more robust or accurate response to motion, and can provide a back-up function in the event that any of the components should fail.

In other respects, the primary inflatable item 1 further comprises a plurality of flow connectors 9, which will be described in further detail hereinafter. It is to be understood that the flow connectors 9 each form part of the above-mentioned control system, together with the controller 8.

In the arrangement illustrated in FIG. 1, the primary inflatable item 1 comprises three such flow connectors 9, each being configured to facilitate releasable fluid connection of the airbag of a respective secondary inflatable item 2-4 to the airbag of the primary inflatable item 1. It is to be appreciated, however, that in other embodiments it is envisaged that the primary inflatable item 1 could comprise a greater number of flow connectors 9 to facilitate releasable fluid connection of a greater number of secondary inflatable items to the primary inflatable item.

In contrast to the primary inflatable item 1, the secondary inflatable items 2-4 do not comprise an actuation unit 6, nor indeed an inflator 7 or a controller 8. However, each secondary inflatable item 2-4 is provided with a respective flexible inflation hose 10, each hose 10 being provided in fluid communication with the airbag of the respective inflatable item 2-4, and extending therefrom to terminate in a respective end connector (not shown) at its free end. Each end connector is configured for releasable connection to any of the flow connectors 9 on the primary inflatable item 1.

Figure 2:
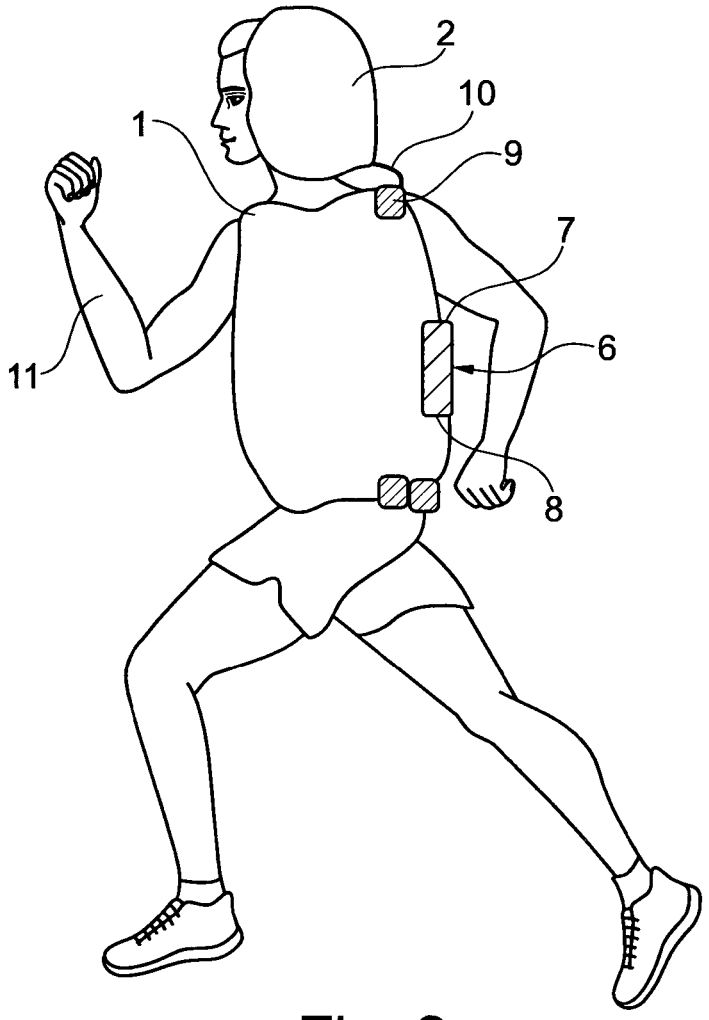
FIG. 2 is a schematic illustration showing a user wearing a plurality of wearable inflatable items selected from those illustrated in FIG. 1, with the worn items being connected to form a system in accordance with an embodiment of the present invention.

Turning now to consider FIG. 2, a user 11 is illustrated wearing two inflatable items selected from the group of inflatable items 1-4 illustrated in FIG. 1. Specifically, the user 11 is shown having elected to wear the primary inflatable item 1 in the form of the vest, and the secondary inflatable item 2 in the form of the helmet. It will be noted, therefore, that the user 11 shown in FIG. 2 is not wearing either of the secondary inflatable items 3, 4 provided in the form of knee pads. The inflation hose 10 of the helmet 2 is shown fluidly connected to one of the flow connectors 9 provided on the primary inflatable item 1, such that the airbags of the two inflatable items being worn are fluidly connected to one another. The other two flow connectors 9 are unconnected to any hose.

Figure 3:
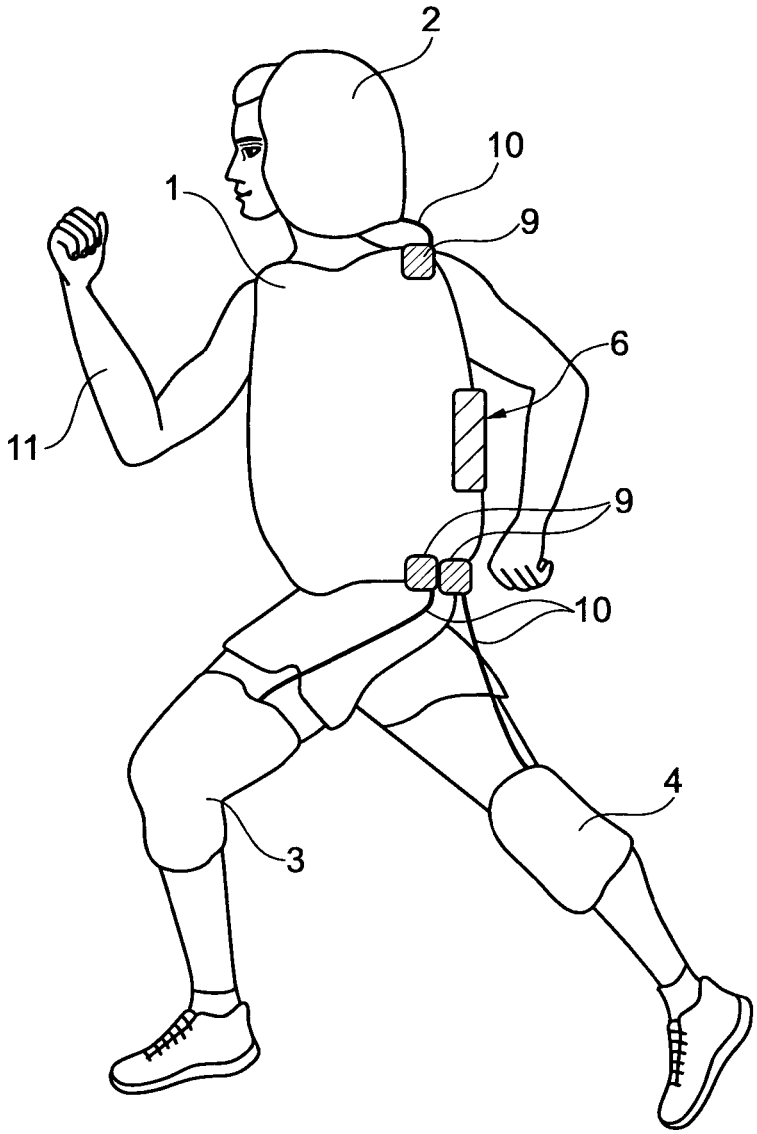
FIG. 3 is a schematic illustration similar to that of FIG. 2, but which shows the user wearing a greater number of wearable inflatable items selected from those illustrated in FIG. 1, to form a larger system.

As mentioned above, the personal impact protection system 5 is intended to be modular, and comprises a number of inflatable wearable items 1-4 from which the user 11 may select items to be worn. Whilst FIG. 2 illustrates the user wearing only two of the full set of inflatable available items, in other circumstances the user may instead elect to wear more than two of the inflatable items—for example as shown in FIG. 3, in which the user 11 is shown wearing all four of the inflatable items 1-4 illustrated in FIG. 1. A user's particular selection of items to be worn may, for example, be based on what activity he or she intends to perform whilst wearing the personal impact protection system 5.

FIG. 3 thus shows the user 11 wearing not only the primary inflatable item 1 in the form of the vest and the secondary inflatable item 2 in the form of the helmet, but also both of the further secondary inflatable items 3, 4 in the form of knee pads. As will be noted, the inflation hose 10 of each knee pad 3, 4 is shown fluidly connected to a respective flow connector 9 provided on the vest 1, such that the airbag of each knee pad 3, 4 is fluidly connected to the airbag of the vest 1. It is envisaged that the user may choose either to connect the hoses 10 to the flow connectors 9 before donning some or all of the inflatable items, or alternatively after donning the items, whichever is deemed more convenient by the user.

Having regard to FIGS. 2 and 3, it will be noted that regardless of how many of the inflatable items 1-4 the user 11 chooses to wear, the user 11 must wear at least the primary inflatable item 1 for the system 5 to be operable. This is because the primary inflatable item 1 is the only inflatable item provided with an inflator 7 or controller 8. Furthermore, it will be understood that regardless of how many of the inflatable items 1-4 the user chooses to wear, the single inflator 7 of the primary inflatable item 1 will function upon actuation to provide inflating gas not only directly to the primary inflatable item 1 itself, but also indirectly to each connected secondary inflatable item 2-4, via their inflation hoses 10. It is envisaged that the inflator 7 will therefore be configured to produce a sufficient volume of inflating gas upon actuation to adequately inflate all of the inflatable items 1-4 provided as part of the system, so that all of the inflatable items may be adequately inflated in the event that the user 11 elects to wear them all.

In the illustrated example, the single inflator 7 is therefore configured to provide sufficient gas to inflate not only the vest 1, but also the helmet 2 and both knee pads 3, 4, so as to provide sufficient inflating gas for the entire system 5 in the event that the user elects to wear all of the inflatable items 1-4 in the system. However, in the event that the user 11 elects not to wear all of the inflatable items 1-4 provided, for example if the user 11 elects to wear only the vest 1 and the helmet 2 as illustrated in FIG. 2, then the volume of gas produced by the inflator 7 will be more than is required to inflate only the vest 1 and the helmet 2. Without any pressure release arrangement, this situation could cause over-inflation of the vest 1 and the helmet 2, which could reduce their effectiveness in providing impact protection to the user, and in extreme cases could risk bursting either or both of the airbags. As will be described below, each flow connector 9 of the control system is therefore specifically configured to vent the airbag of the primary inflatable item 1 (i.e. the vest) in the event that no inflation hose 10 of a secondary inflatable item 2-4 is connected to it and inflation pressure inside the airbag exceeds a predetermined threshold.

Figure 4:
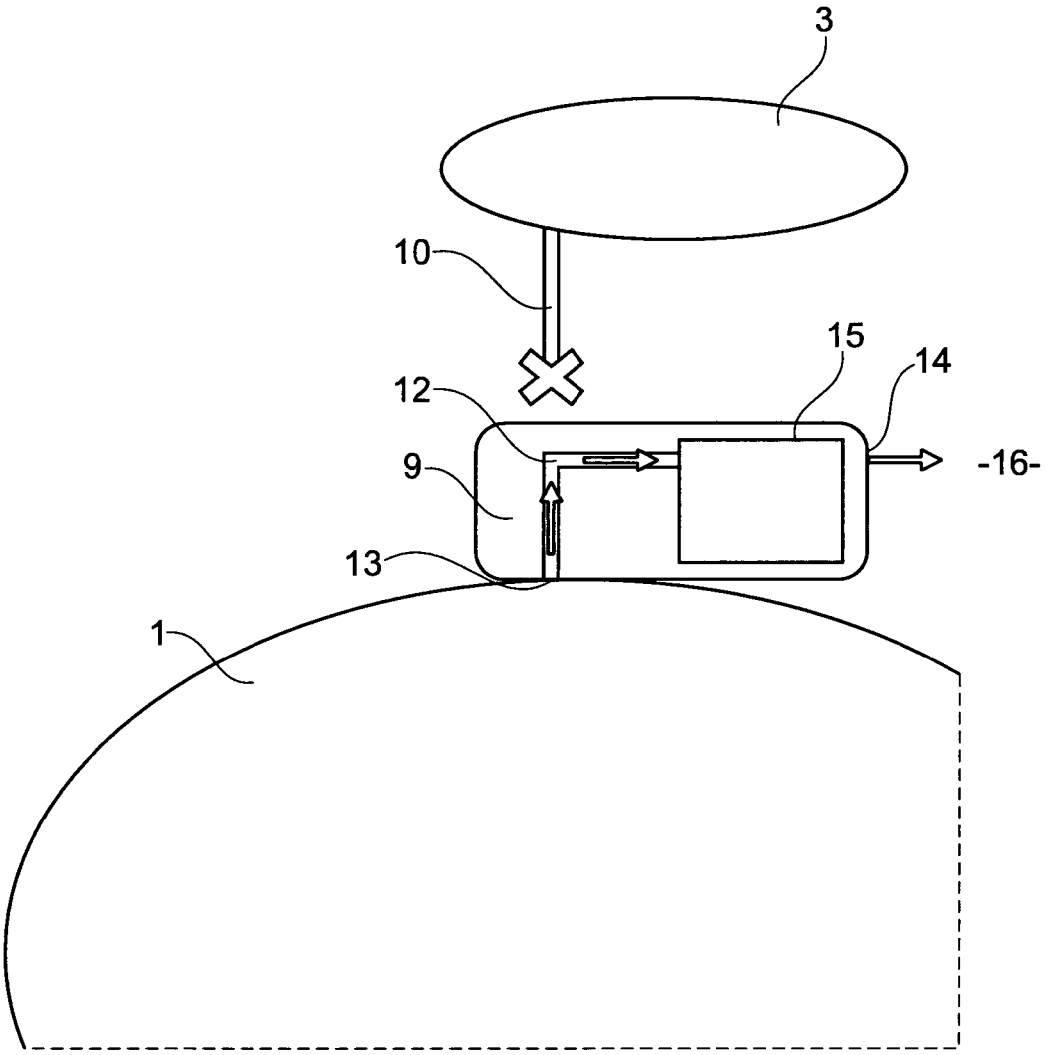
FIG. 4 is a schematic illustration showing a flow connector which is associated with a primary inflatable item and which is configured for releasable fluid connection to a secondary inflatable item, the secondary inflatable item being shown disconnected from the primary inflatable item.

FIG. 4 illustrates schematically one of the flow connectors 9 provided on the primary inflatable item 1. FIG. 4 shows the flow connector disconnected from the inflation hose 10 of the illustrated adjacent secondary inflatable item 3, and thus represents the situation applicable to the two lowermost flow connectors 9 illustrated in FIG. 2 to which no secondary inflatable item is connected. The flow connector 9 is shown affixed to the airbag of the primary inflatable item 1 in FIG. 4. However, it is to be appreciated that in other embodiments it is envisaged that the flow connector 9 may be located at the end of a short length of hose fluidly connected to the airbag, so as to be spaced somewhat from the airbag, thereby permitting more convenient location of the flow connector 9 with respect to the user's body.

The flow connector 9 has an internal flow conduit 12 which extends from a flow inlet 13 in fluid communication with the airbag to a vent outlet 14, via a pressure relief valve 15. The pressure relief valve 15 is shown in FIG. 4 in an operable condition in which it will normally be closed, so as to block the flow conduit 12 and thus prevent flow of inflating gas from the airbag of the primary inflatable item 1 to the vent aperture 14. However, the pressure relief valve 15 is configured to open in response to the upstream fluid pressure, and thus the inflation pressure within the airbag of the primary inflatable item 1, exceeding a predetermined threshold value, whereupon the flow conduit is opened between the flow inlet 13 and the vent outlet 14, thereby permitting inflation gas to vent from the primary inflatable item 1 through the vent outlet 14 to the surrounding atmosphere 16, as indicated by the flow arrows shown in FIG. 4. It is proposed that the pressure relief valve 15 will also be configured so that it will, for example subsequently, close in response to the upstream fluid pressure, and thus the inflation pressure within the airbag of the primary inflatable item 1, falling below the predetermined threshold value, to thereby prevent inflation gas from venting from the primary inflatable item 1.

As will be appreciated, it is envisaged that the predetermined threshold inflation pressure at which the pressure relief valve 15 will open is set at an appropriate level to i) ensure adequate inflation of the primary inflatable item 1 in the absence of a connected secondary inflatable item 3 and thus to provide adequate impact protection to the user 11, and ii) ensure that the primary inflatable item 1 (and any secondary inflatable items connected to it) does not become dangerously overinflated. In some embodiments, it is proposed that the pressure relief valve 15 may be adjustable so that its predetermined threshold value may be adjusted.

Figure 5:
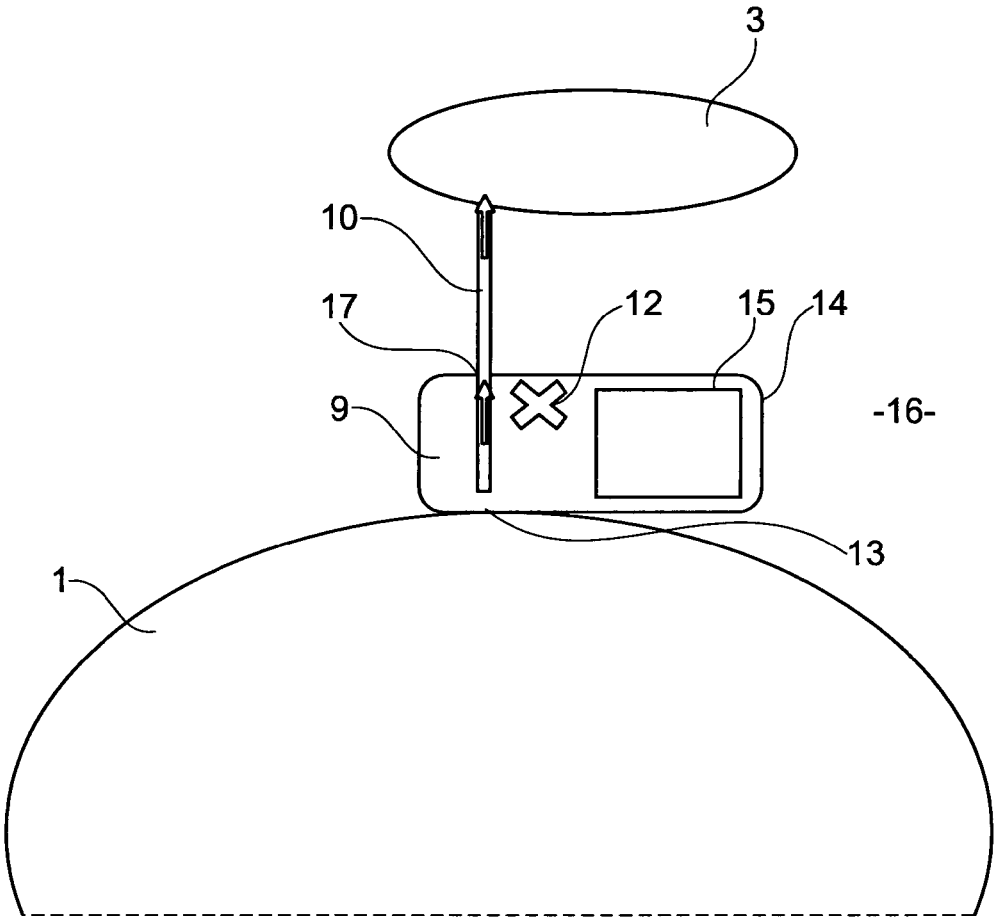
FIG. 5 is a schematic illustration corresponding generally to that of FIG. 4, but which shows the secondary inflatable item connected to the primary inflatable item.

Turning now to consider FIG. 5, the same flow connector 9 is illustrated in an alternate configuration in which the end connector of the inflation hose 10 of the secondary inflatable item 3 has been connected to the flow connector 9. Specifically, the end connector of the inflation hose 10 is shown mechanically and fluidly connected to an inflation outlet 17 provided on the flow connector 9.

The flow connector 9 may be configured such that connection of the end connector of the inflation hose 10 to the inflation outlet 17 mechanically switches the pressure relief valve 15 from its operable condition illustrated in FIG. 4 to an inoperable condition as shown in FIG. 5, in which the flow conduit 12 is blocked upstream of the flow control valve 15. Alternatively, however, it is envisaged that in other embodiments the flow connector 9 may be equipped with a sensor to sense connection of an inflation hose 10 to the inflation outlet 17, and the controller 8 may be configured to detect connection (and indeed also disconnection) of an inflation hose 10 to the inflation outlet 17 and to control switching of the pressure relief valve 15 between its operable and inoperable conditions in response to said detection. In still further embodiments, it is proposed that each secondary inflatable item 2-4 may be provided with a secondary controller (not illustrated) which is configured to detect connection and disconnection of the respective secondary inflatable item 2-4 to the primary inflatable item 1 in the described manner, and to control switching of the respective pressure relief valve between said operable condition and said inoperable condition in response to said detection.

As will thus be appreciated from FIG. 5, when the inflation hose 10 is connected to the flow connector 9, the pressure relief valve 15 is rendered inoperable by being fluidly isolated from the airbag of the primary inflatable item 1, such that the primary inflatable item 1 can no longer be vented to the surrounding atmosphere 16. As will also be appreciated, when the inflation hose 10 is connected to the flow connector 9 as shown, a flow path is opened up from the airbag of the primary inflatable item 1 to the secondary inflatable item 3, via the inflation hose 3, such that actuation of the inflator 7 on the primary inflatable item 1 will serve to inflate not only the primary inflatable item 1 directly, but also the connected secondary item 3 indirectly. Disconnection of the inflation hose 10 from the flow connector 9 will serve to close the inflation outlet 17 and reopen the flow conduit 12 to the pressure relief valve 15, thereby switching the pressure relief valve 15 back to its operable condition illustrated in FIG. 4, thereby restoring the possibility of the primary inflatable item 1 venting to the surrounding atmosphere 16 in the event that its inflation pressure reaches or exceeds the predetermined threshold value.

Returning now to consider FIGS. 2 and 3 in particular, the control system comprising the controller 8 and the flow connectors 9 is configured to select an inflation characteristic from a group of possible inflation characteristics comprising:

i) inflation of all of the inflatable items (for example: inflation of all of the vest 1, helmet 2, and both knee pads 3, 4 being worn in FIG. 3);

ii) inflation of some but not all of inflatable items (for example: inflation of only the vest 1 and helmet 2 being worn in FIG. 2, but not the two knee pads 3, 4 not being worn); and iii) inflation of a single one of the inflatable items (for example; inflation of only the vest 1 in the unillustrated case that the user is wearing only the vest 1 and not also the helmet 2 or the knee pads 3, 4).

As will be appreciated, the or each inflatable item being worn is thus inflated by inflating gas produced by the single inflator 7, under the control of the single controller 8. If any of the flow connectors 9 are not connected to a secondary inflatable item, then the pressure relief valves 15 of those particular flow connectors 9 will be set to their operable conditions so as to permit venting of inflating gas from the primary inflatable item 1 to the atmosphere 16 in the event that the inflation pressure within the primary inflatable item 1 reaches or exceeds the predetermined threshold value. Furthermore, if any of the flow connectors 9 are connected to a secondary inflatable item, then the pressure relief valves of those flow connectors 9 will be set to their inoperable conditions so as to prevent venting of the primary inflatable item 1 to the atmosphere 16 and to instead direct inflating gas into the respective secondary inflatable items.

In some embodiments, it is proposed that the controller 9 may furthermore be configured to select the appropriate inflation characteristic in dependence on the actuation signal produced by the gyro sensor. For example, the controller 8 may be configured to determine, from the actuation signal, how or in what direction the user 11 might be falling, or how or in what direction the user 11 might be likely to impact with his or her surrounding environment (such as the interior of a motor vehicle in one example, or the road or pavement in another example), and to select an appropriate number and selection of the inflatable items 1-4 being worn to inflate in order to offer the user 11 an appropriate level of protection. In the case that the controller 8 selects an inflation characteristic requiring one or more of the inflatable items 1-4 being worn not to be inflated, then it is proposed that the controller 8 will electrically switch the pressure relief valve 15 of the or each corresponding respective flow connector 9 from its inoperable condition to its operable condition, regardless of the fact that the flow connector 9 is connected to the inflation hose 10 of a secondary inflatable item, and to fluidly isolate the respective inflation hose 10 from the airbag of the primary inflatable item 1.

Figure 6:
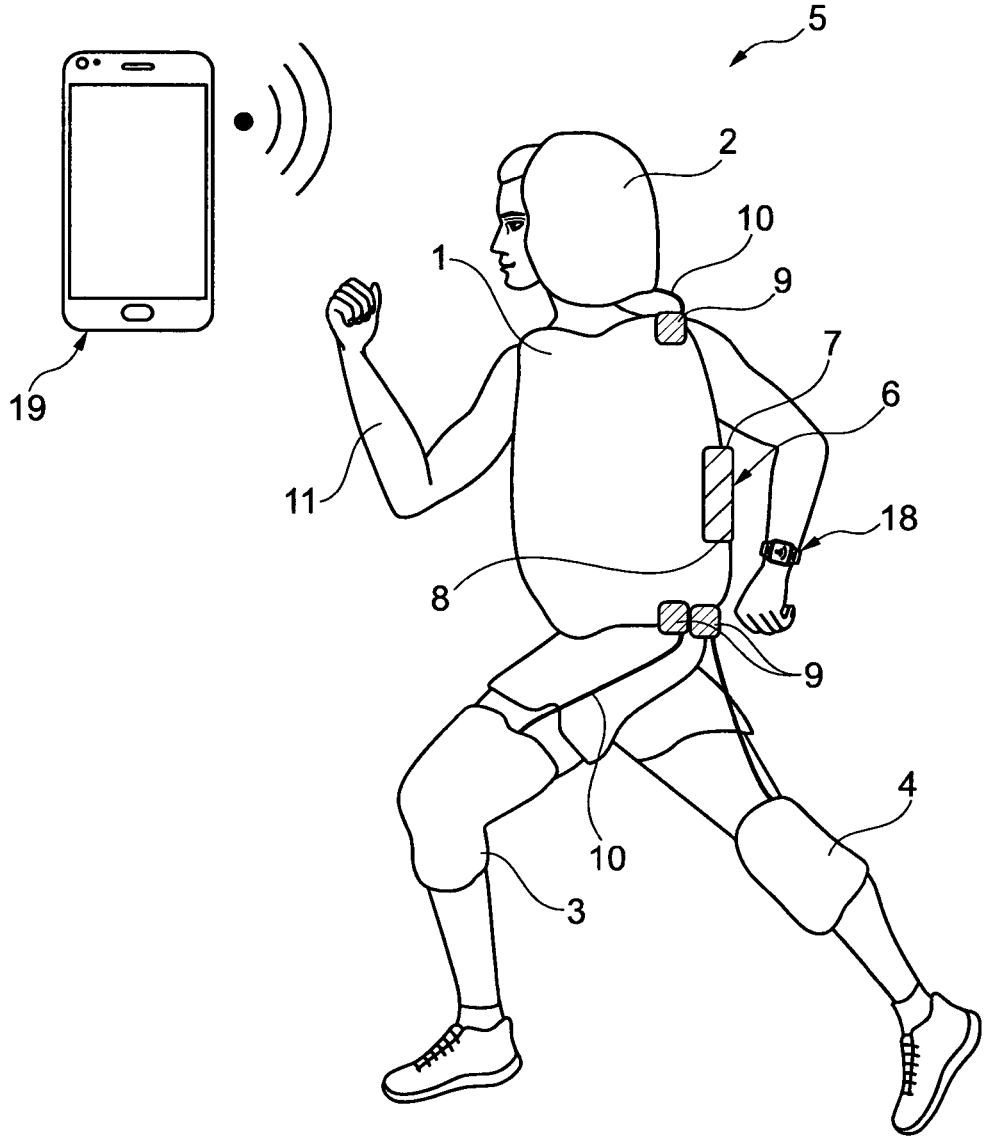
FIG. 6 is a schematic illustration similar to that of FIG. 3, but which shows the user wearing wearable inflatable items forming part of a system in accordance with a modified embodiment.

Turning now to consider FIG. 6, there is illustrated a modified version of the above-described personal impact protection system 5 being worn by a user 11. In particular, it will be observed that the user 11 is illustrated wearing all of the inflatable items 1-4 provided in the system 5, namely: the primary inflatable item in the form of the vest 1, the secondary inflatable item in the form of the helmet 2, and both of the secondary inflatable items in the form of knee pads 3, 4. The user 11 is also illustrated wearing a so-called 'smart-watch' 18 of a type known per se. Additionally, FIG. 6 depicts schematically a so-called 'smartphone' of a type also known per se, which could, however, be substituted by a tablet or other similar external computer device. It is envisaged that the smartphone 19 could be carried by the user 11, for example in a pocket provided either on one of the inflatable items being worn (for example the vest 1), or alternatively in a pocket on the user's own conventional clothing.

It is proposed that in some embodiments of the present invention, an external device such as the illustrated smart-watch 18 or smartphone 19 could form part of the control system of the personal impact protection system 5, in combination with the controller 8 and the flow connectors 9. It is therefore proposed that the smart-watch 18 and/or the smartphone 19 may be configured to run a software application implementing the aforementioned actuation algorithm.

As will be understood, it is common for modern smartphones and smart-watches to contain one or more accelerometers or gyro sensors. It is therefore proposed that in some embodiments, the integral accelerometer or gyro sensor of the smart-watch 18 and/or the smartphone 19 could form part of the control system and thus be used to produce the aforementioned actuation signal in response to the detection of a linear or angular acceleration exceeding a predetermined threshold value indicative of the user being likely to suffer an impact. In such embodiments, the controller 7 of the primary inflatable item 1 may be configured to communicate wirelessly with the smart-watch 18 and/or the smartphone 19, for example via the Bluetooth protocol. As will be appreciated, however, other wireless protocols could be used instead to provide communication between the smart-watch 18 and/or the smartphone 19. In embodiments of this type, it is envisaged that the system may be configured to actuate the inflator 8 in response to the receipt of an actuation signal issued wirelessly by the smart-watch 18 and/or the smartphone 19. Alternatively, it is proposed that the controller 7 could be configured to communicate with the external device via a wired connection, for example in the form of a Lightning cable or USB cable.

In some variants of the present invention, it is proposed that the smart-watch 18 and/or the smartphone 19 may be configured to run a software application which permits a user to exercise some control over the actuation characteristics of the system 5. For example, the software application could present the user with a range of different activities (such as cycling, walking, cross-country hiking, or climbing), with each activity having a slightly different actuation characteristic such as different response times, inflation rates, or other characteristics. The software application could also present the user 11 with an option to temporarily disable the system 5.

Figure 7:
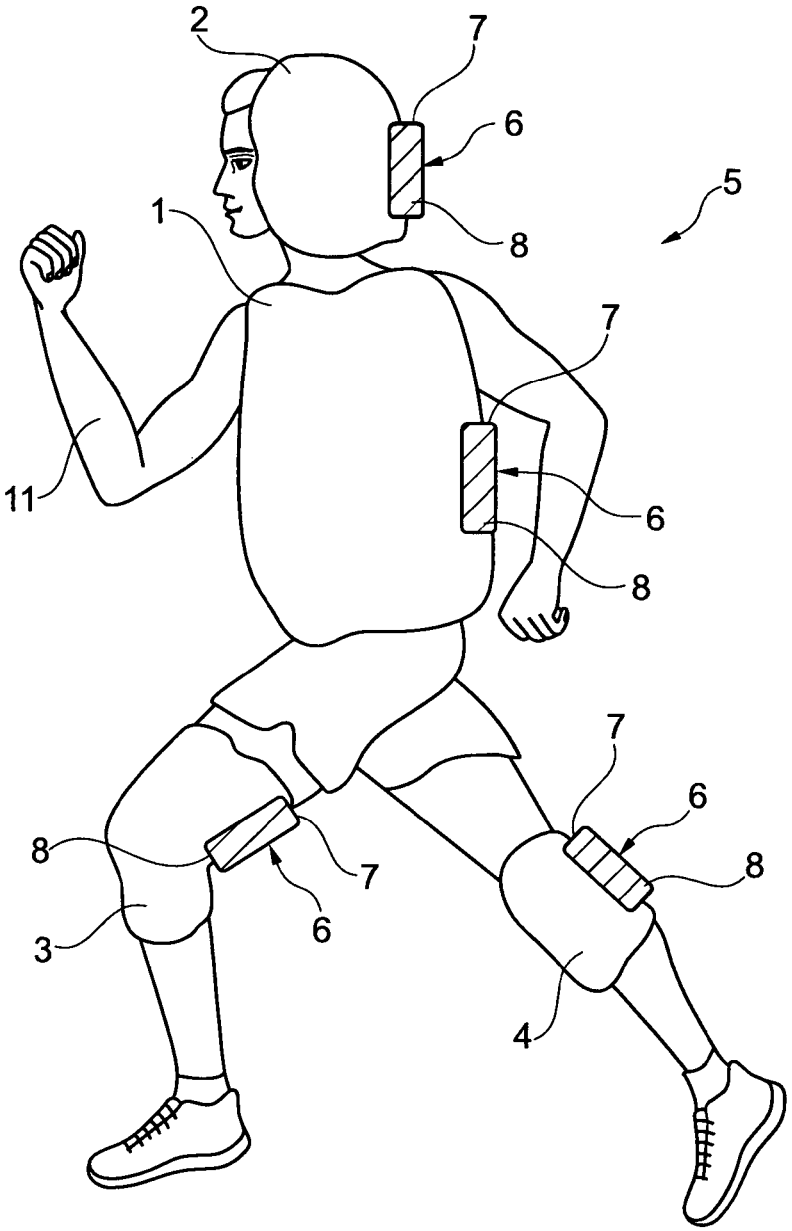
FIG. 7 is a schematic illustration showing a user wearing a plurality of inflatable wearable items forming a system in accordance with a further embodiment.

Turning now to consider FIG. 7, there is illustrated a user 11 wearing a number of inflatable items 1-4 forming at least part of a personal impact protection system in accordance with another embodiment. For convenience, the user 11 is shown wearing inflatable items of generally similar configuration to those illustrated in FIGS. 1 to 6, and which thus include a vest 1, a helmet 2, and a pair of knee pads 3, 4.

Also, the user 11 is shown wearing all of the available inflatable items provided in the system 5. It is to be appreciated, however, that in a similar manner to that described above, the user 11 may instead wear fewer inflatable items, or indeed could wear additional or alternative inflatable items if provided as part of the system 5.

An important difference between the system 5 illustrated in FIG. 7 and that described above with reference to FIGS. 1 to 6 is that in the system 5 of FIG. 7 each inflatable item 1-4 comprises its own respective unit 6 which comprises an inflator 7 such as a gas generator of a type known per se, and a controller 8 which may be provided in the form of an electronic control unit (ECU). Whilst FIG. 1 illustrates the inflator 7 and the controller 8 of each inflatable item 1-4 being combined into a single respective actuator unit 6, it is to be appreciated that variants are envisaged in which the inflator 7 and the controller 8 of each inflatable item may be provided as discrete units, and optionally at different positions on the respective inflatable item 1. As will be appreciated, each controller 8 forms part of the control system, is operably connected to the respective inflator 7, and is configured to actuate the inflator 7 in response to an actuation signal and in accordance with an actuation algorithm, in a generally similar manner to that described above with reference to the embodiments of FIGS. 1 to 6.

As will thus be appreciated, another significant difference between the system 5 shown in FIG. 7 and those described above with reference to FIGS. 1 to 6 is that in the system of FIG. 7 the airbag of each inflatable item 1-4 is configured to receive inflating gas directly from its respective inflator 7. The airbags of the various inflatable items 1-4 in the system are thus all fluidly isolated from one another. Furthermore, it is proposed that the inflator 7 of each individual inflatable item 1-4 will be configured to produce a predetermined volume of inflating gas upon actuation which is appropriate for the inflatable volume of the respective airbag. Thus it is proposed, for example, that the vest 1 which has a relatively large inflatable volume, will have a larger inflator than, for example, the helmet 2 and each knee pad 3, 4 which have relatively small inflatable volumes, such that the inflator of the vest 1 will produce a larger volume of inflating gas upon actuation than the inflators of the smaller inflatable items in the system 5.

Each inflatable item 1-4 may comprise its own respective accelerometer or gyro sensor configured to produce a respective actuation signal in response to the detection of a local linear or angular acceleration exceeding a predetermined threshold value indicative of the respective part of the user's body around or about which the inflatable item is worn being likely to suffer an impact. The accelerometer or gyro sensor of each inflatable item 1-4 may either be incorporated within the respective actuator unit 6, or may be located elsewhere on the inflatable item.

Figure 8:
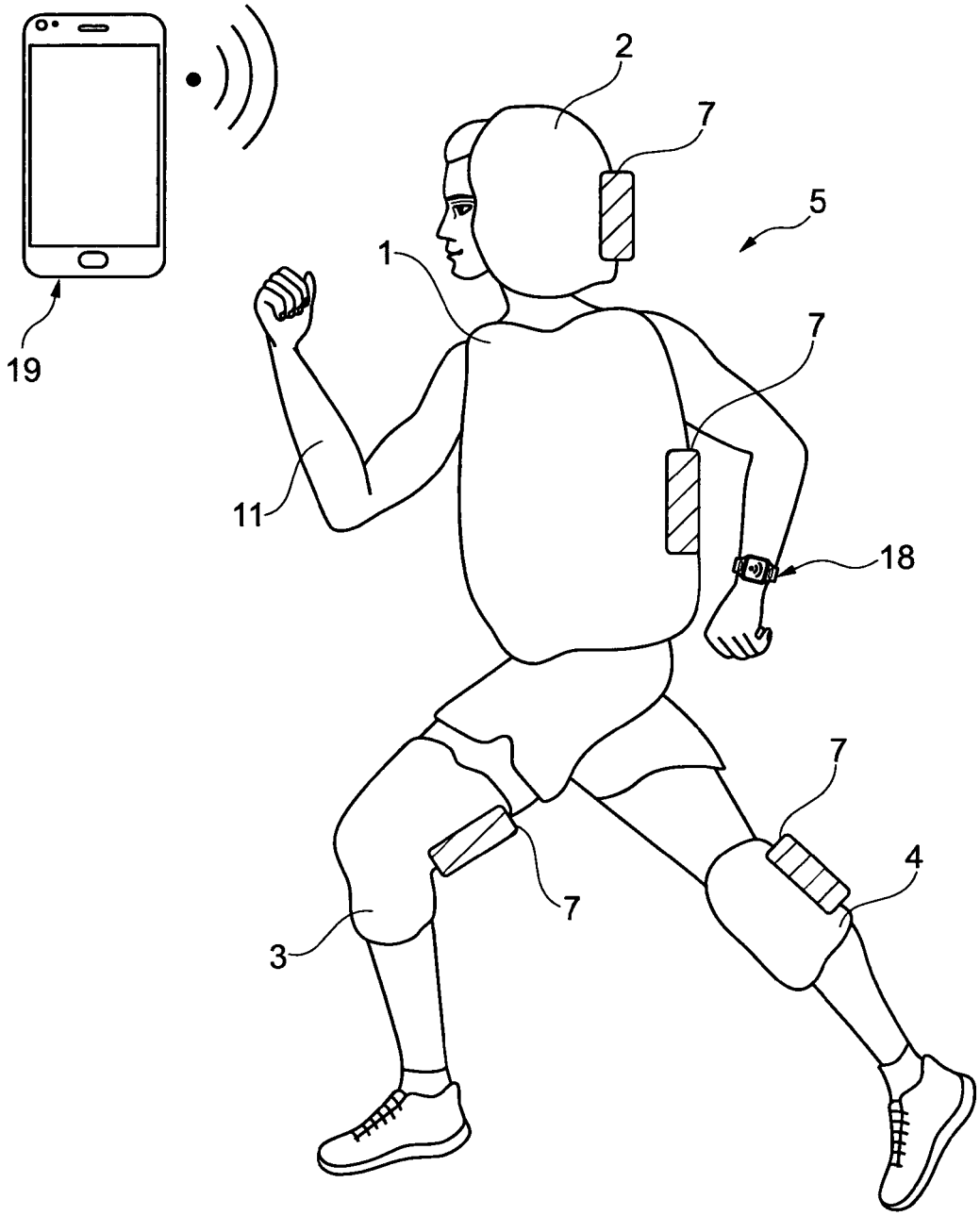
FIG. 8 is a schematic illustration similar to that of FIG. 7, but which shows a user wearing a plurality of inflatable wearable items forming a system in accordance with a modified embodiment.

Turning now to consider FIG. 8, there is illustrated a modified version of the personal impact protection system 5 shown in FIG. 7. In particular, it will be observed that the user 11 is illustrated wearing all of the inflatable items 1-4 provided in the system 5, namely: the vest 1, the helmet 2, and both knee pads 3, 4. The user 11 is also illustrated wearing a smart-watch 18, and FIG. 8 depicts also smartphone 19. The system 5 shown in FIG. 8 is thus somewhat similar to that illustrated in FIG. 6 in the sense that it may incorporate a smart-watch 18 and/or a smartphone 19. As will again be appreciated, the smartphone 19 could be carried by the user 11, for example in a pocket provided either on one of the inflatable items being worn (for example the vest 1), or alternatively in a pocket on the user's own conventional clothing.

It is proposed that an external device such as the illustrated smart-watch 18 or smartphone 19 could form part of the control system of the personal impact protection system 5, in combination with the controllers 8. It is therefore proposed that the smart-watch 18 and/or the smartphone 19 may be configured to run a software application implementing the aforementioned actuation algorithm. The integral accelerometer or gyro sensor of the smart-watch 18 and/or the smartphone 19 may part of the control system and thus be used to produce an actuation signal in response to the detection of a linear or angular acceleration exceeding a predetermined threshold value indicative of the user being likely to suffer an impact. In such embodiments, the controllers 8, or at least one of the controllers 8, may be configured to communicate wirelessly with the smart-watch 18 and/or the smartphone 19 (and/or with one another or a main ECU), for example via the Bluetooth protocol. As will be appreciated, however, other wireless protocols could be used instead to provide communication between the smart-watch 18 and/or the smartphone 19. In embodiments of this type, it is envisaged that the system may be configured to actuate each inflator 7 in response to i) receipt of a main actuation signal issued wirelessly by the smart-watch 18 and/or the smartphone 19, and ii) receipt of a check signal from the respective local accelerometer or gyro sensor.

In some variants of the proposal illustrated in FIG. 8, it is proposed that the smart-watch 18 to and/or the smartphone 19 may also be configured to run a software application which permits a user to exercise some control over the actuation characteristics of the system 5. For example, the software application could present the user with a range of different activities (such as cycling, walking, cross-country hiking, or climbing), with each activity having a slightly different actuation characteristic such as different response times, inflation rates, or other characteristics. The software application could also present the user 11 with an option to temporarily disable the system 5. These types of functions may be provided even in the event that the internal gyro sensor of the smart-watch 18 and/or the smartphone 19 are not used as part of the control system.

Figure 9:
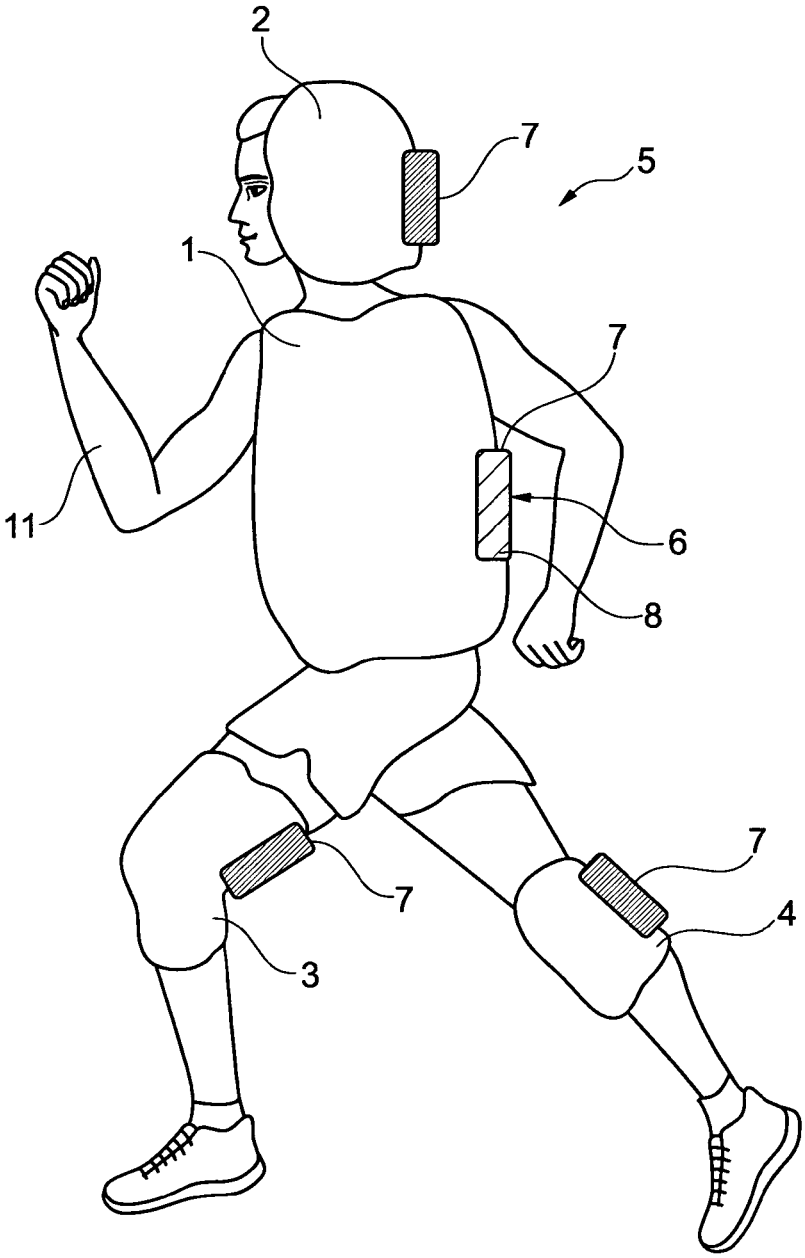
FIG. 9 is a schematic illustration showing a user wearing a plurality of inflatable wearable items forming part of a system in accordance with another further embodiment.

Turning now to consider FIG. 9, there is illustrated a user 11 wearing a number of inflatable items 1-4 forming at least part of a personal impact protection system in accordance with another embodiment. For convenience, the user 11 is again shown wearing inflatable items of generally similar configuration to those illustrated in FIGS. 1 to 6, and which thus include a vest 1, a helmet 2, and a pair of knee pads 3, 4. Also, the user 11 is shown wearing all of the available inflatable items provided in the system 5. It is to be appreciated, however, that in a similar manner to that described above in connection with the system shown in FIG. 7, the user 11 may instead choose to wear fewer inflatable items, or indeed could wear additional or alternative inflatable items if provided as part of the system 5.

An important difference between the system 5 illustrated in FIG. 9 and that described above with reference to FIG. 7 is that in the system 5 of FIG. 9 only one of the inflatable items is provided with a controller 8. In the specific arrangement illustrated, the vest 1 is provided with the only controller 8 of the system 5, and may thus be considered to represent a primary inflatable item of the system 5, with the other inflatable items 2-4 of the system representing secondary inflatable items lacking their own controllers. The controller 8 may be provided in the form of an electronic control unit (ECU), and as part of an actuator unit 6 to similar to that described above in connection with the embodiment of FIGS. 1 to 6. Also in common with the arrangement described above with reference to FIGS. 1 to 6, the actuator unit 6 of the primary inflatable item 1 also comprises an inflator 7 such as a gas generator of a type known per se, to which the controller 8 is operably connected. It is nevertheless to be appreciated that in variants of the embodiment illustrated in FIG. 9 it is envisaged that the inflator 7 and the controller 8 may be provided as discrete units, and optionally at different positions on the primary inflatable item 1. It should also be noted that whilst it is generally advantageous for the single controller 8 of the system to be provided on a vest 1 or similar garment intended to worn around the user's torso, this is not considered essential, and the single controller 8 could instead be provided on another inflatable item of the system.

The secondary inflatable items of the system 5, which in the specific example illustrated in FIG. 9 include the helmet 2 and the knee pads 3, 4, are each provided with a respective inflator 7, but no controller. The inflator 7 of each secondary inflatable item 2-4 may be of generally similar or even identical configuration to the inflator 7 of the primary inflatable item 1. The single controller 8 provided on the primary inflatable item 1 is nevertheless operably connected to the inflator 7 of each secondary inflatable item 2-4. This connection may be a wired connection, such that an actuation cable (not shown) of each secondary inflator 7 may be electrically connected to the actuation unit 6, and thus the controller 8, of the primary inflatable item 1 by the user 11 when donning the various inflatable items 1-4. Alternatively, it is proposed that the controller 8 may be wirelessly connected to each of the other inflators 7, for example by respective Bluetooth connections. In variants of the invention, it is proposed that the controller 8 may have a proximity sensing arrangement configured to detect and wirelessly connect to the inflator 7 of each secondary inflatable item 2-4 when the respective inflator 7 is within a predetermined range indicative of the respective secondary inflatable item 2-4 being worn by the user 11 in addition to the primary inflatable item 1.

As will be appreciated, the system of FIG. 9 is similar to the system of FIG. 7 in the sense that the airbag of each inflatable item 1-4 is again configured to receive inflating gas directly from its own dedicated respective inflator 7. The airbags of the various inflatable items 1-4 in the system 5 of FIG. 9 are thus all fluidly isolated from one another. Furthermore, it is proposed that the inflator 7 of each individual inflatable item 1-4 will be configured to produce a predetermined volume of inflating gas upon actuation which is appropriate for the inflatable volume of the respective airbag. Thus it is proposed, for example, that the vest 1, which has a relatively large inflatable volume, will have a larger inflator than, for example, the helmet 2 and each knee pad 3, 4 which each have a relatively small inflatable volume, such that the inflator of the vest 1 will produce a larger volume of inflating gas upon actuation than the inflators of the smaller inflatable items in the system 5.

It is proposed that the primary inflatable item 1 may comprise a gyro sensor configured to produce an actuation signal in response to the detection of acceleration exceeding a predetermined threshold value indicative of the user being likely to suffer an impact. The gyro sensor may either be incorporated within the actuator unit 6 of the primary inflatable item 1, or may be located elsewhere on the primary inflatable item 1.

Having regard to FIG. 9, it will be noted that regardless of how many of the inflatable items 1-4 the user 11 chooses to wear, the user 11 must wear at least the primary inflatable item 1 for the system 5 to be operable. This is because the primary inflatable item 1 is the only inflatable item provided with a controller 8.

Figure 10:
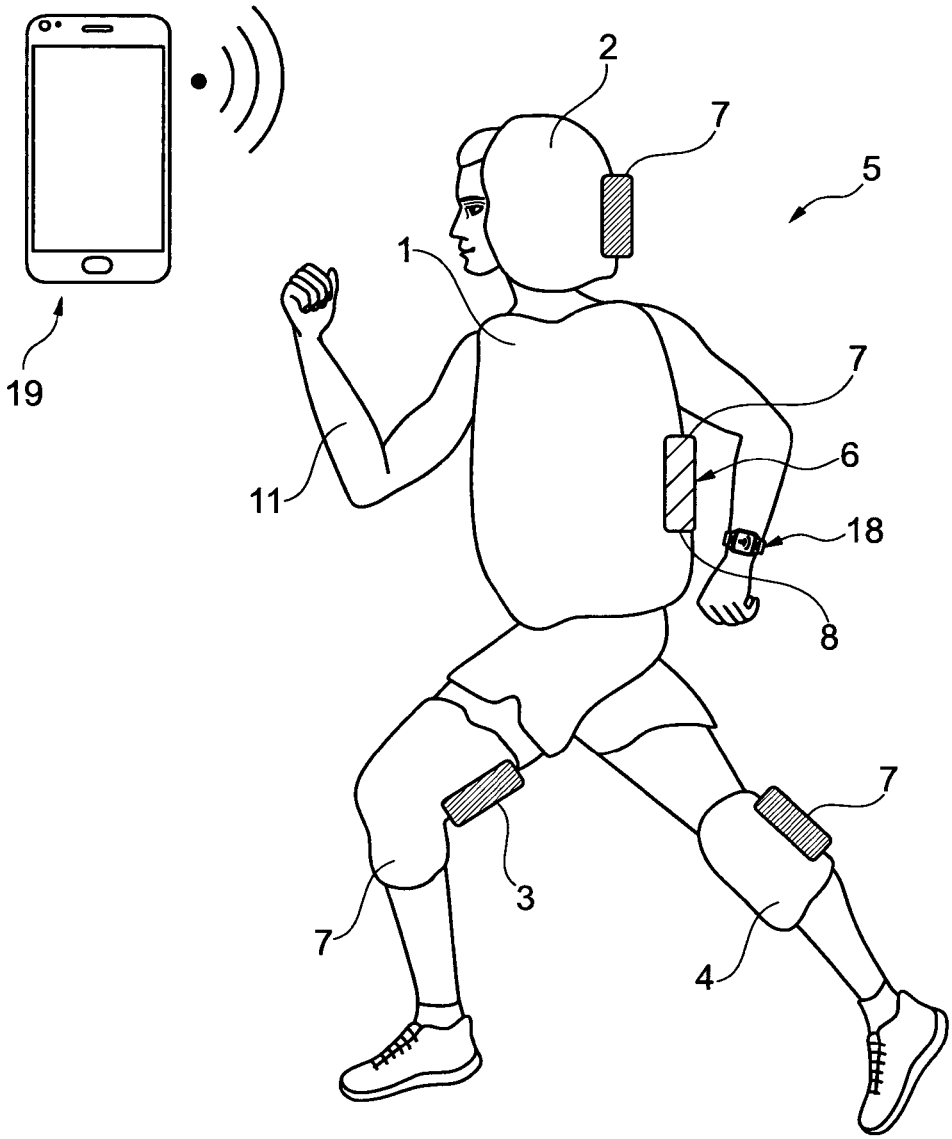
FIG. 10 is a schematic illustration similar to that of FIG. 9, but which shows a user wearing a plurality of inflatable wearable items forming a system in accordance with a modified embodiment.

Turning now to consider FIG. 10, there is illustrated a modified version of the personal impact protection system 5 shown in FIG. 9. In particular, it will be observed that the user 11 is illustrated wearing all of the inflatable items 1-4 provided in the system 5, namely: the vest 1, the helmet 2, and both knee pads 3, 4. The user 11 is also illustrated wearing a smart-watch 18, and FIG. 10 depicts also smartphone 19. The system 5 shown in FIG. 10 is thus somewhat similar to that illustrated in FIG. 8 in the sense that it may incorporate a smart-watch 18 and/or a smartphone 19. As will again be appreciated, the smartphone 19 could be carried by the user 11, for example in a pocket provided either on one of the inflatable items being worn (for example the vest 1), or alternatively in a pocket on the user's own conventional clothing.

It is proposed that an external device such as the illustrated smart-watch 18 or smartphone 19 could form part of the control system of the personal impact protection system 5, in combination with the controller 8. It is therefore proposed that the smart-watch 18 and/or the smartphone 19 may be configured to run a software application implementing the aforementioned actuation algorithm. The integral gyro sensor of the smart-watch 18 and/or the smartphone 19 may part of the control system and thus be used to produce an actuation signal in response to the detection of angular acceleration exceeding a predetermined threshold value indicative of the user being likely to suffer an impact. In such embodiments, the controller 8, may be configured to communicate wirelessly with the smart-watch 18 and/or the smartphone 19, for example via the Bluetooth protocol. As will be appreciated, however, other wireless protocols could be used instead to provide communication between the smart-watch 18 and/or the smartphone 19. In embodiments of this type, it is envisaged that the system may be configured to actuate each inflator 7 in response to i) receipt of a main actuation signal issued wirelessly by the smart-watch 18 and/or the smartphone 19, and ii) receipt of a check signal from the respective local gyro sensor.

In some variants of the proposal illustrated in FIG. 10, it is proposed that the smart-watch 18 and/or the smartphone 19 may also be configured to run a software application which permits a user to exercise some control over the actuation characteristics of the system 5, in the same manner as proposed above in connection with the arrangement illustrated in FIG. 8. For example, the software application could present the user 11 with a range of different activities (such as cycling, walking, cross-country hiking, or climbing), with each activity having a slightly different actuation characteristic such as different response times, inflation rates, or other characteristics. The software application could also present the user 11 with an option to temporarily disable the system 5. These types of functions may be provided even in the event that the internal gyro sensor of the smart-watch 18 and/or the smartphone 19 are not used as part of the control system.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the invention that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

The invention claimed is:

1. A personal impact protection system for protection of a user's body comprising: a plurality of discrete wearable inflatable items configured to be worn on or around respective parts of the user's body; an inflator configured to produce a flow of inflating gas to inflate the plurality of inflatable items when worn by the user; wherein the plurality of inflatable items are each fluidly connectable to the inflator to receive the flow of inflating gas from the inflator according to an actuation algorithm, the plurality of inflatable items including a primary inflatable item which includes the inflator and which is configured to receive the inflating gas directly from the inflator, wherein the plurality of inflatable items further includes at least one secondary inflatable item being releasably fluidly connectable to the primary inflatable item by at least one flow connector to receive the flow of inflating gas indirectly from the inflator via the primary inflatable item when connected to the primary inflatable item, wherein the at least one flow connector each comprising a switchable pressure relief valve and being configured to switch between an operable condition and an inoperable condition, wherein the operable condition occurs when the at least one secondary inflatable item is not connected to the primary inflatable item, and wherein in the operable condition, the switchable pressure release valve vents the primary inflatable item to atmosphere in response to inflation pressure within the primary inflatable item exceeding a predetermined threshold; and the switchable pressure relief valve is configured, in the inoperable condition which occurs when the at least one secondary inflatable item is connected to the primary inflatable item, not to vent the primary inflatable item to atmosphere in response to inflation pressure within the primary inflatable item exceeding the predetermined threshold;

the system further comprising a control system operably connected to the inflator and the at least one flow connector and configured to actuate the inflator in response to an actuation signal and in accordance with an inflation characteristic selected from a group of:

i) inflation of all of the plurality of inflatable items;

ii) inflation of some but not all of the plurality of inflatable items; and iii) inflation of a single one of the plurality of inflatable items;

wherein the control system is configured detect connection and disconnection of the at least one secondary inflatable item and to select the inflation characteristic in dependence on at least one of: the actuation signal; and a determination of which of the plurality of inflatable items are worn by the user.

2. The personal impact protection system according to claim 1, wherein the user selects one or more of the plurality of wearable inflatable items to be worn, wherein the actuation algorithm is configured to determine which of the plurality of inflatable items are worn and to select the inflation characteristic in dependence thereon.

3. The personal impact protection system according to claim 1, wherein the control system comprises at least one controller operably connected to the inflator and configured to implement the actuation algorithm.

4. The personal impact protection system according to claim 1, wherein the control system comprises at least one gyro sensor configured to produce the actuation signal in response to detection of an angular velocity exceeding a predetermined threshold value.

5. The personal impact protection system according to claim 1, wherein the at least one flow connector is configured to:

i) switch the respective switchable pressure relief valve from the operable condition to the inoperable condition upon connection of a respective of the at least one secondary inflatable item to the primary inflatable item; and ii) to switch the respective switchable pressure relief valve from the inoperable condition to the operable condition upon disconnection of the respective secondary inflatable item from the primary inflatable item.

6. The personal impact protection system according to claim 1, wherein the control system comprises a single controller configured to implement the actuation algorithm, the controller being configured to:

i) actuate the inflator in accordance with the actuation algorithm, and ii) detect a connection and a disconnection of one of the at least one secondary inflatable item to the primary inflatable item and to control switching of the or each respective switchable pressure relief valve between the operable condition and the inoperable condition in response to the detection.

7. The personal impact protection system according to claim 1, wherein the primary inflatable item comprises a primary controller configured to actuate the inflator in accordance with the actuation algorithm, and wherein one of the at least one secondary inflatable item comprises a respective secondary controller, the respective secondary controller being configured to detect a connection and a disconnection of the at least one secondary inflatable item to the primary inflatable item and to control switching of the switchable pressure relief valve between the operable condition and the inoperable condition in response to the detection.

* * * * *